US006243971B1

(12) United States Patent
Hofft

(10) Patent No.: US 6,243,971 B1
(45) Date of Patent: Jun. 12, 2001

(54) ARRANGEMENT FOR SHOE WEAR

(76) Inventor: Krzysztof Hofft, Senapsgatan 18, 424 43 Angered (SE)

( * ) Notice: Subject to any disclaimer, the term of this patent is extended or adjusted under 35 U.S.C. 154(b) by 0 days.

(21) Appl. No.: 09/349,333

(22) Filed: Jul. 8, 1999

(30) Foreign Application Priority Data

Mar. 30, 1999 (SE) ..... 9901192

(51) Int. Cl.[7] ..... A43C 11/00; A43C 11/12
(52) U.S. Cl. ..... 36/50.1; 24/438
(58) Field of Search ..... 36/50.1, 50.5; 24/437, 438, 439, 441

(56) References Cited

U.S. PATENT DOCUMENTS

| | | | | |
|---|---|---|---|---|
| 1,218,499 | * | 3/1917 | Weede | 24/438 |
| 1,220,602 | * | 3/1917 | Campbell et al. | 24/438 |
| 1,648,651 | * | 11/1927 | Marinetti | 24/438 |
| 1,678,273 | * | 7/1928 | Schutz | 36/50.1 |
| 2,175,901 | * | 10/1939 | Konovaloff | 36/50.1 |
| 2,268,003 | | 12/1941 | Walters . | |
| 3,122,810 | * | 3/1964 | Lawrence et al. | 24/438 |
| 3,999,256 | * | 12/1976 | MacFee | 24/438 |
| 4,104,768 | * | 8/1978 | Labecki | 24/70 R |
| 5,117,567 | * | 6/1992 | Berger | 36/50.1 |

* cited by examiner

*Primary Examiner*—M. D. Patterson
(74) *Attorney, Agent, or Firm*—Fasth Law Offices; Rolf Fasth

(57) ABSTRACT

The arrangement for shoe wear is for removable attachment of the shoe wear about the user's foot so that the fastening may be achieved by tightening two parts (6, 7) that are separated by a cavity (3) and locked in a tight position. According to the invention, at least one transverse locking part (11) is attached across the cavity. The transverse locking part is attached to the separated parts (6, 7) on each side of the cavity. The transverse locking part is, at least on one side of the cavity, shiftably attached and is movable along the cavity so that the fastening of the shoe wear may occur when the locking part is moved so that the parts are pulled towards one another. The locking part is lockable in different setting positions along the tracks.

11 Claims, 7 Drawing Sheets

ARRANGEMENT FOR SHOE WEAR

FIELD OF THE INVENTION

The present invention relates to an arrangement for a shoe wear for removable attachment of the shoe wear about the user's foot wherein the fastening is achieved by the tightening of two parts of the shoe that are separated by a cavity and locked in a tightened position and wherein the cavity extends from an opening of the shoe wear towards to shoe sole.

BACKGROUND AND SUMMARY OF THE INVENTION

For a long time, the dominating method of attaching different types of shoe wear about a user's foot is to use shoe laces. The method of using shoe laces has many advantages. It is very inexpensive. The only thing that is required is a number of openings for the shoe laces at the separate parts into which the shoe laces may be inserted to be able to tighten the separate parts about the foot of the user. Different persons that have substantially the same shoe size have different widths and different heights of the feet along the length of the foot that can often be compensated for by tightening the shoe laces differently. Of particular importance is that it is possible to achieve a very high tensioning force which may be important when using, for example, certain types of boots.

However, shoe laces have several drawbacks. A certain finger dexterity is required for tying shoes which causes problems for small children and persons with reduced dexterity in the arms and fingers. Furthermore, shoe laces may easily get untied if they are not tied properly. The wear on the shoe laces is significant if they are often un-tied and the user steps on them. The shoe laces may also be a risk factor if they are not properly tied so that they untie and the user may trip over them or if, for example, the shoe laces get caught in a moving stairway.

The problems with shoe laces have resulted in the search for other solutions. One solution that is used on some types of shoes are zippers. One advantage with zippers is that they are easier to use than shoe laces. A significant drawback with zippers is that the tightness in the sideways direction cannot be varied. The separated parts must completely merge when using a zipper and each point along the zipper is fixed in the sideways direction. The usefulness of zippers for shoe wear is therefore limited. Another drawback is that the zipper sometimes require a lot of strength to pull up the zipper.

Another solution that nowadays are sometimes used is velcro fastening mechanisms. As opposed to shoe laces, velcro fastening mechanisms may be maneuvered by using one hand and it is easy to vary the tightness of the shoe about the user's foot. This is a significant advantage compared to zippers. A substantial drawback with velcro fastening mechanism is the relatively large separated parts on the shoe wear that must be connected and overlap one another to provide a sufficient tightening force and because it is also desirable to vary the width of the shoe wear to adjust to the width of the user's foot, it is required that very large portions of the components have the velcro locking mechanism. The material required is therefore often substantially greater when velcro fastening mechanisms are used compared to shoe laces and zippers. Although it could be imagined that only the velcro components overlap one another, the usefulness of such a solution is limited for aesthetical reasons. The reason because the velcro locking mechanism on shoes is not a completely satisfactory solution depends greatly upon the fact that the aesthetical appearance of the shoe wear is much affected by the velcro locking mechanism. These are mostly used on athletic shoes and are not hardly used on any shoes require more aesthetical appearance.

Thus, there is a longstanding need for a fastening mechanism for shoes that is easier to handle than shoe laces and that does not have the drawbacks associated with zippers and velcro fastening mechanisms as mentioned above.

The present invention has accomplished an arrangement for shoe wear that eliminates the above mentioned problems associated with the already known and above described fastening mechanisms.

The arrangement according to the present invention includes at least one transverse locking part that extends across the cavity. The transverse locking part is attached in the separate parts on each side of the cavity. The transverse locking part is, at least on one side of the cavity, movably attached and movable along the cavity so that the tightening of the shoe wear is accomplished when the locking part is moved so that the above mentioned parts are pulled towards each other.

A suitable embodiment of the present invention has a track, or something similar thereto, that is arranged on each side of the cavity. The tracks extend mainly in a direction along the length of the cavity and is adapted to diverge in the direction towards the opening of the shoe wear at least when the user has inserted his foot into the shoe wear and before the tightening of the parts have been done. The transverse locking part extends across the cavity between the tracks and are attached to a movable member of the tracks. The shoe wear is open to be put on or taken off when the cavity is open and the locking part is situated at a greatest distance from the opening and the tightening is performed when the locking part is moved in the direction where the tracks diverge and thus the separated parts are pulled in a direction towards one another and the locking part is lockable in different positions along the tracks.

The arrangement of the present invention may be handled by using only one hand when putting on and taking off the shoe. When the shoe is put on, the user pulls the locking part in a direction towards the opening of the shoe and when taking off the shoe, the locking part is pulled in an opposite direction. No particular finger dexterity is required for tightening or loosening of the shoe.

According to a suitable embodiment of the present invention, the locking part, that extends between the tracks across the cavity, is adjustable to shorten or lengthen the extension of the locking part between the tracks so that the locking part may be adjustable to the various foot widths of the users.

According to another embodiment of the present invention, the tracks and the locking parts are a separate unit that is permanently or removably attached to a conventional shoe wear. The attachment of the tracks may be performed with rivets or adhesives or removably attached with fastening mechanisms that are engaged in the holes used for the shoe laces.

An advantage of the latter embodiment is obviously that conventional shoe wear with conventional shoe laces may, in an easy and inexpensive way, be complemented with the arrangement of the present invention. A person who has injured his arm, for example, when the arm is broken, can thus complement a pair of his own shoes with the arrangement of the present invention and during the healing period can put on and take off his shoes himself.

BRIEF DESCRIPTION OF THE DRAWINGS

The invention is described in more detail with the reference to a couple of embodiments that are shown on the attached drawings, wherein.

DETAILED DESCRIPTION

Figure 1:
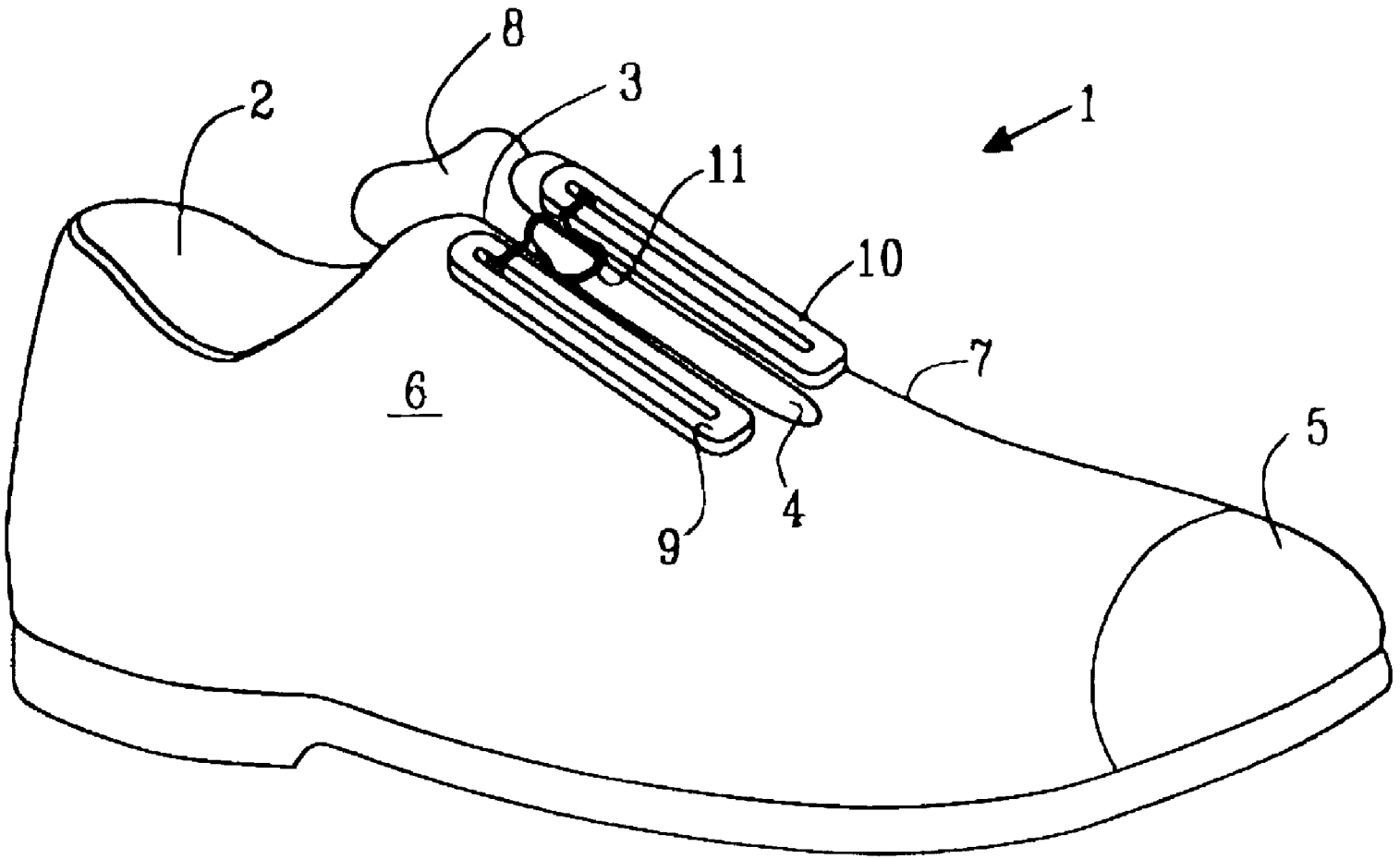
FIG. 1 is a perspective view from the side of a shoe that schematically shows the arrangement according to the invention.

In FIG. 1, the shoe as a whole has been labelled with the reference 1. A lengthwise extending cavity 3 is defined on the upper side of the shoe in front of the opening 2. An upper portion of the cavity 3 is open towards the opening 2 and a lower or front end 4 is disposed a distance from the front end 5 of the shoe. The cavity 3 is thus of the type that most shoes with shoe laces have. The cavity 3 separates two parts 6 and 7 on the upper side of the shoe that are adapted to be pulled towards one another when the shoe is tightened about the user's foot. A conventional tongue 8 is attached inside the cavity 3 that, at least when the shoe is tightened about the user's foot, seals any remaining gaps of the cavity 3. The tongue may be of the kind that is only attached to the front end below the end 4 at the cavity 3 or of the kind that has one entire side attached to the upper side of the shoe below the parts 6 and 7 and the tongue is made thinner than the rest of the shoe. The tongue is easily folded and conforms when the parts 6 and 7 are tightened.

On each side of the cavity 3 are tracks 9 and 10 arranged. A locking part 11 is disposed between both tracks that is in contact with the tracks by a respective member that is movable within the tracks. The function of the attachment member with the locking part will be described in more detail below. FIG. 1 shows the locking part 11 in a tightened position that is the parts 6 and 7 are tightened about the user's foot.

Figure 2:
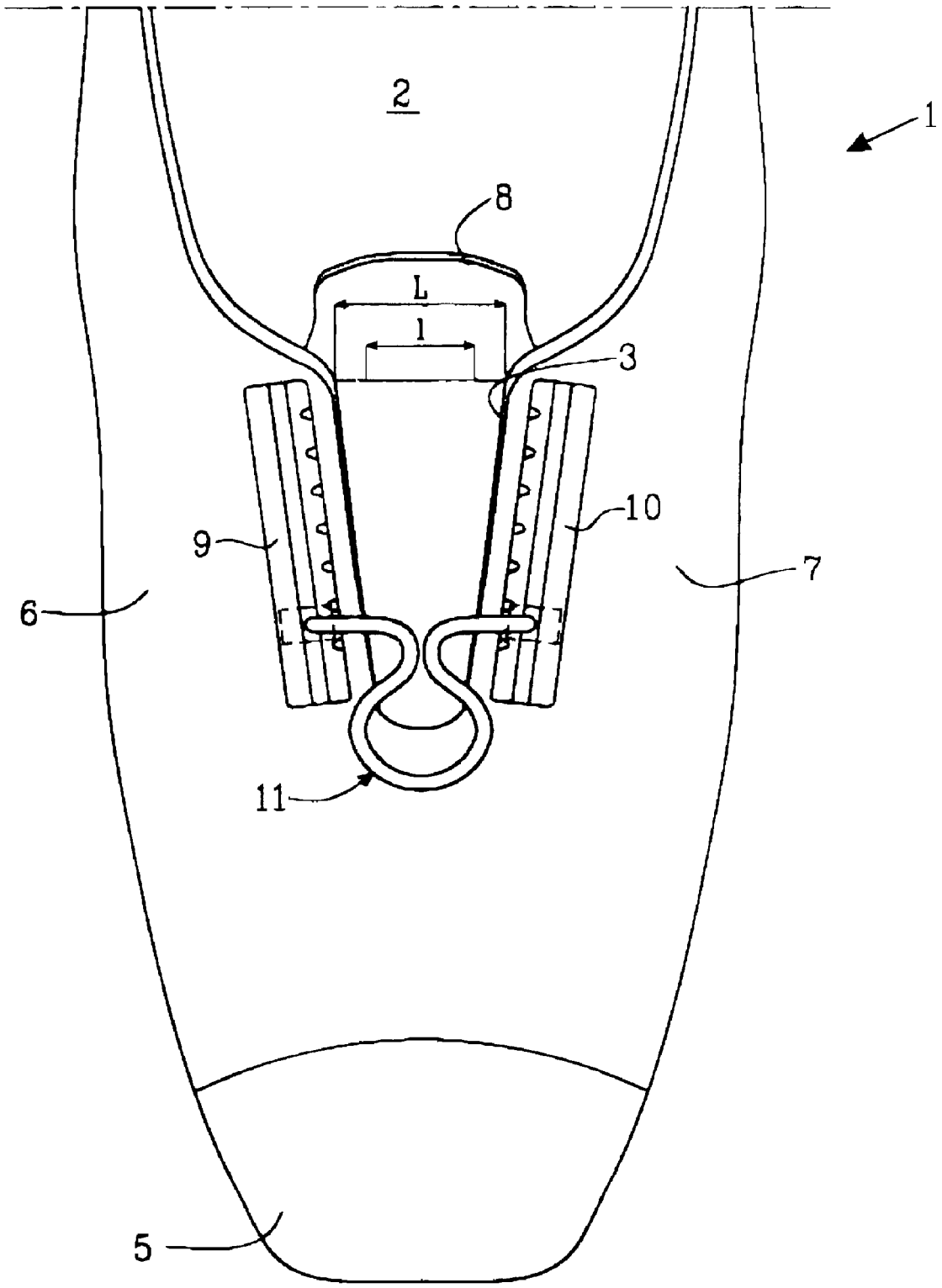
FIGS. 2 and 3 show a schematic more detailed view from above of an arrangement according to a first embodiment of the invention in an open and closed attachment position, respectively.
Figure 3:
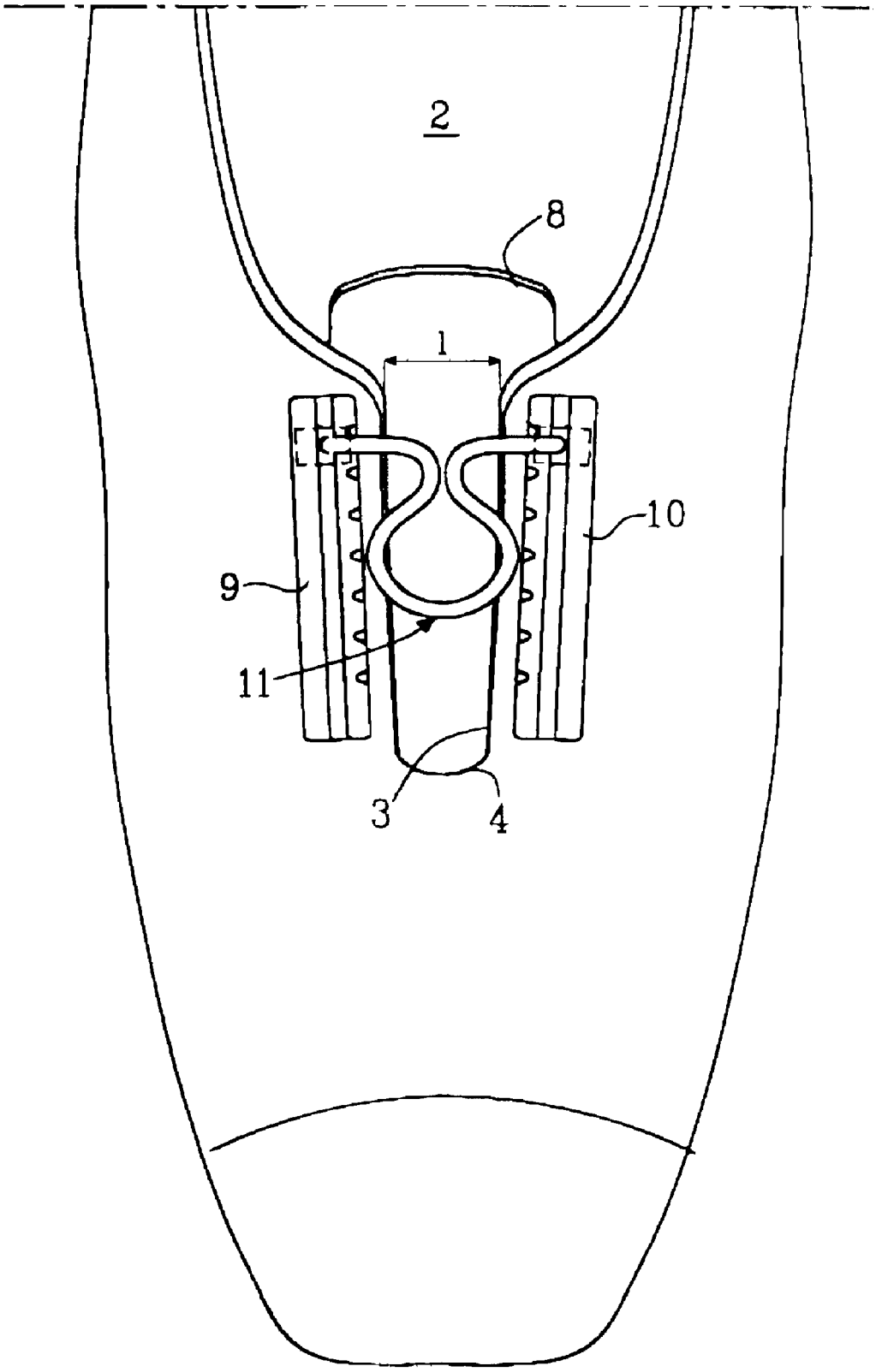

The embodiment according to FIGS. 2 and 3 includes the same reference numerals as the parts shown above in FIG. 1. FIGS. 2 and 3 show both tracks 9 and 10 on each side of the cavity 3. When the shoe is open, the locking part 11 is thus in a lower position and the cavity 3 is wider at its upper part, at least when a user has inserted his/her foot (not shown) into the shoe and stretched out the shoe in a sideways direction so that the parts 6 and 7 have been separated. This situation is shown in FIG. 2. The tracks 9 and 10 diverge at least in this position in a direction from the lower end 4 of the cavity towards the opening 2. The locking part is made from a material that is substantially stiff in view of the tensioning that occurs when the shoe is tightened about the user's foot. When the shoe is tightened, the locking part is pulled upwardly from the position shown in FIG. 2 to the position shown in FIG. 3 so that the locking part during its movement is pulling the tracks 9 and 10 towards one another wherein the parts 6 and 7 are pulled along and the width of the cavity is reduced at the upper part of the cavity. The width of the cavity has in FIGS. 2 and 3 been shown as L before the tightening of the shoe and as 1 after the tightening of the shoe.

Figure 4:
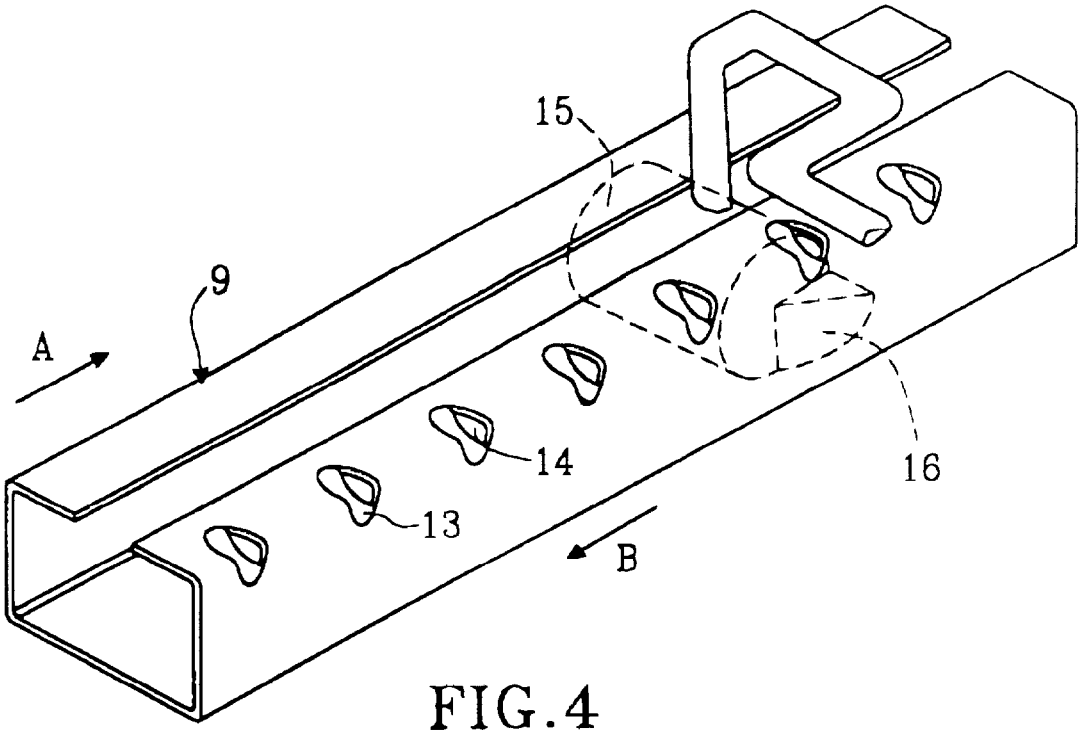
FIGS. 4 and 5 show an enlarged view of the mechanism member of FIGS. 2 and 3 in a locked and opened position disposed in a track.
Figure 5:
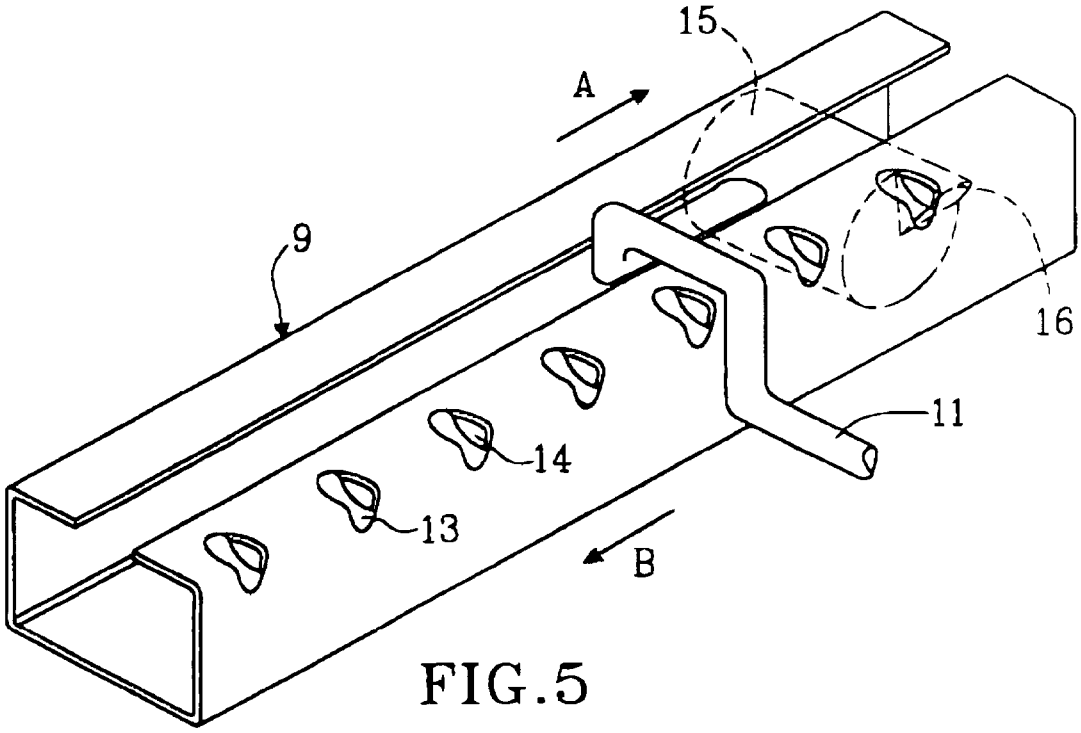

FIGS. 4 and 5 show the tracks 9 and 10 in cooperation with the movable member that is in engagement with the tracks and attached to the locking part 11. The tracks include an upwardly partly open groove that has a cross sectional substantially rectangular shape. The tracks or grooves are made of plastic or metal and the side facing the cavity has a hole 13. In the shown embodiment, the hole 13 has been formed by punching a hole in the material, that is, so that, as shown in the drawing, the flap 14 formed from the punched hole is bent into the tracks. The locking part 11 is attached to a member 15 that is movable inside the track. In the embodiment shown, the member has the shape of a cylinder that has a hook 16 protruding from one end of the cylinder.

When the shoe is tightened, the locking part and the cylinder 15 move in a direction of the arrow A in FIGS. 4 and 5. FIG. 4 shows the arrangement according to the present invention in a tightened and locked position. When the separated parts 6 and 7 have been pulled towards the center by the locking part, the locking part is influenced by a force that is biased to move the locking part in a direction to open the shoe, that is, in a direction towards the front end of the shoe. A stop member is therefore required to hold the locking member in place in the tightened position. The flaps 14 are the stop members in the embodiment shown in FIG. 4. As shown in FIG. 4, the hook 16 is in engagement with the flap 14 and prevents the locking member from moving in the direction of the arrow B. If the locking part 11 and thus the cylinder 15 are turned into the position shown in FIG. 5, the hook 16 is disengaged from the flap 14 and the locking part may be moved in the direction to open the shoe, that is, in the direction of the arrow B in FIG. 4.

Preferably, the hook 16 is rounded off so that when in the locked position it may pass below the stop member 14 when the locking member is moved along the track in the direction of the arrow A, that is, when a user only needs to pull the locking part in the direction of the arrow A to tighten the shoe.

Figure 6:
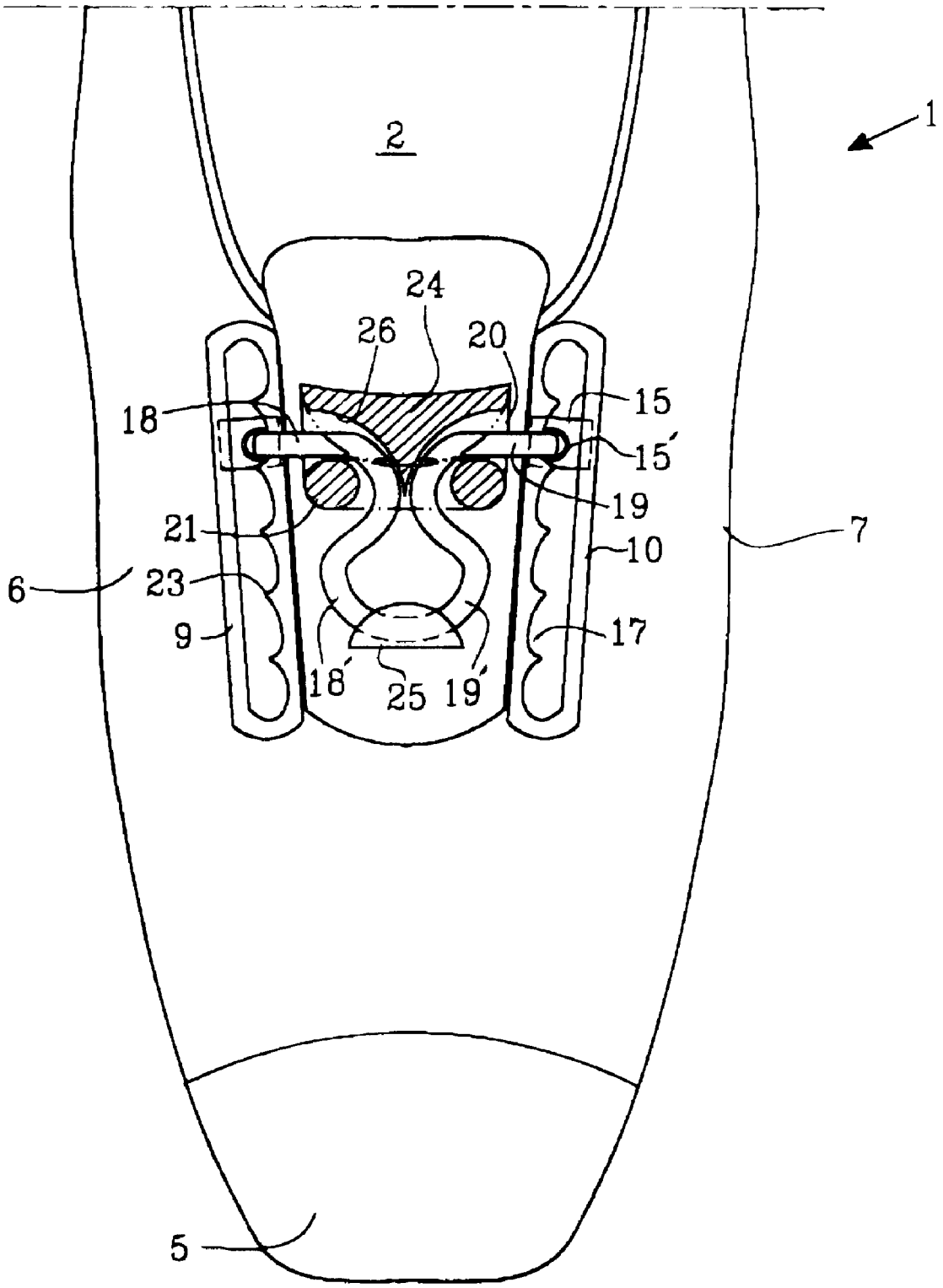
FIGS. 6 and 7 show a schematic view of a second embodiment of the present invention in an opened and closed attachment position, respectively, similar to the views of FIGS. 2 and 3.
Figure 7:
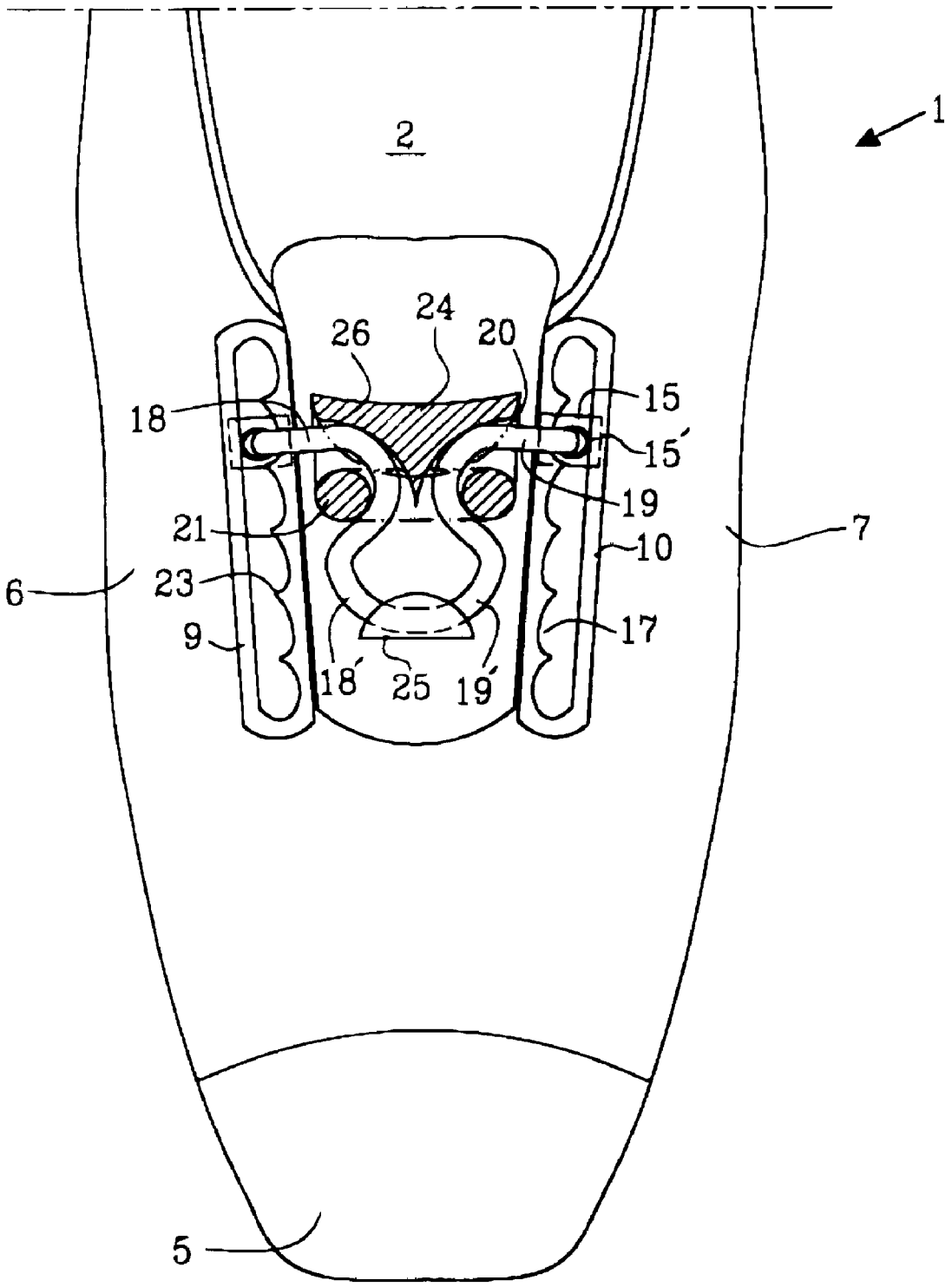

In the embodiment shown in FIGS. 6 and 7, the tracks 9 and 10 and the locking part 11 are designed differently compared to the corresponding parts of the embodiments according to FIGS. 2–4. The locking part 11 includes a fastener that is only attached by movable members with the reference number 15 to both the tracks 9 and 10. The tracks 9 and 10 have a wave top like upper limitation surface at a tracking side 17 that is turned towards the cavity 3. Outer transverse arms 18 and 19 of the locking part 11 are attached to the members 15 that are movable within the tracks and height adjustable (not shown in detail). Right opposite the wave top like tracking sides 17 are the outer transverse arms 18, 19 bent in a direction towards the members 15 that are movable and attached to the tracks. The transverse arms 18, 19 are surrounded by a roller 15' that is in engagement with the wave top like limitation surface, tracking side 17. The roller is freely and rotatably attached to reduce the friction between the tracking surface 17 and the locking part as it is moved along the tracks. The locking part 11 or the fastener has a washer 20 that includes a clamp 21 that keeps the arm portions 18' and 19' in place. When the fastener is not affected and is in the position, as shown in FIG. 7, the arms 18, 18' and 19, 19' determine the width of the locking part and thus the distance between the tracks 9 and 10, that is, when the shoe is tightened the tracks are influenced by an outward force that is counteracted by the arms 18, 19 that are held by the clamp 21.

The wave top like limitation surface 17 has such a design that the locking part 11 or the fastener can be moved in the direction of tightening while any movement in the opposite direction is prevented by the wave tops 23 of the tracking surfaces 17. The locking part or the fastener is equipped with two opposite gripping parts 24, 25 that may be pushed towards one another when it is desirable to bring the movable member 15 of the locking part and more particularly the roller 15' out of engagement with the wave tops to move the locking part in the direction of opening.

Below the gripping part 24 are guide surfaces 26 that may press the arms 18, 19 in an outward direction and thus to disengage the rollers 15' from the tracking surface 17 when the gripping parts 24 and 25 are pressed towards one another.

In FIG. 6, the locking part 11 or the fastener is shown in an open position that is in a position in which it may be moved in the direction of the opening.

Figure 8:
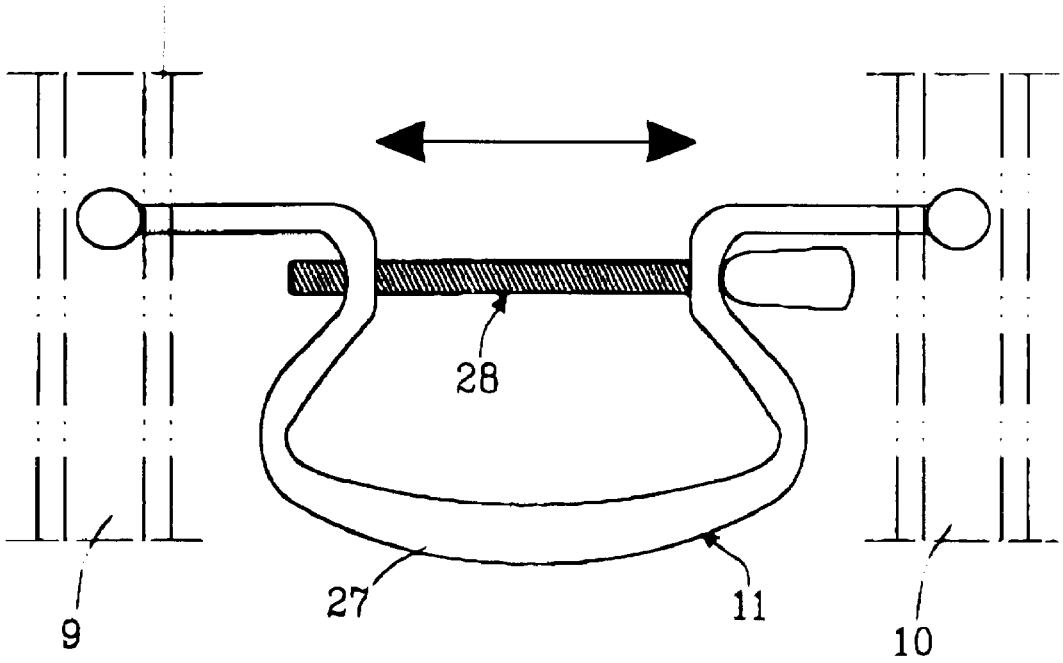
FIGS. 8 and 9 show different embodiments of a locking mechanism of the arrangement.
Figure 9:
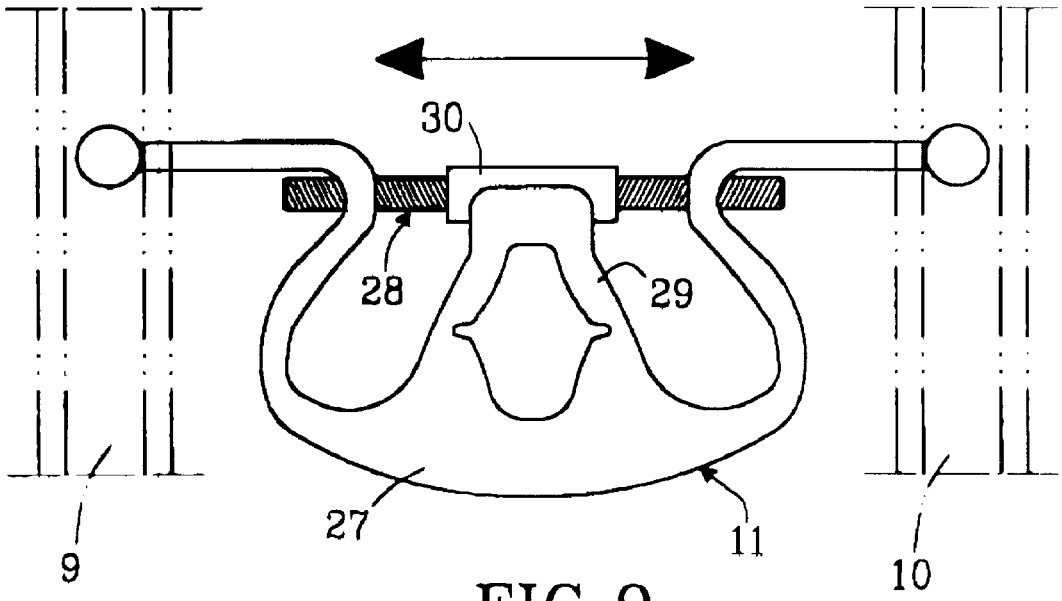

FIGS. 8 and 9 show some examples of different types of locking parts or fasteners that are suitable for use in the arrangement according the present invention. FIGS. 8 and 9 are using the same reference numerals for the corresponding parts described above.

In FIG. 8, the locking part 11 has a loop 27 that is made from the same material as the rest of the locking part, preferably of plastic or metal. A tightening screw 28 may be disposed through the loop, as shown in the figure. The locking part 11 is attached to the members 15 that are movable within the tracks 9, 10, as described above. With the help of the tightening screw, the locking part may be made longer or shorter that is, the distance between the tracks 9, 10 may be varied to adjust to the different widths of the feet of the user.

FIG. 9 shows a locking part or fastener that is somewhat modified relative to the embodiment shown in FIG. 8. The loop 27 has been complemented with a pulling loop 29 that extends at an angle relative to the loop 27 and protrudes upwardly a bit so that a user may directly grab the pulling loop 29 to tighten the shoe. The tightening screw 28 has a maneuver part 30 at the middle and both the screw parts that extend from the middle has different thread direction so that the locking part is made longer and shorter by turning the middle portion 30.

The invention is not limited to the above described embodiments and numerous modifications are possible within the scope of the appended patent claims.

In the appended patent claims, the expression shoe wear has been used. This expression includes different types of shoes, dress shoes, athletic shoes, boots, semi-boots etc.

The expression tracks that has been used above and in the appended patent claims includes channel formed grooves, as described above, but also other types of guide paths that cooperate with complementing members on the locking part so that the locking part via the tracks may tighten or release separate parts on the upper side of the shoe by moving the locking part along the tracks. The guide paths may for example be rail shaped and the complementing element may surround the rail. The guide paths may also be cross-sectionally L-shaped and cooperate with complementing members on the locking part.

In the illustrated examples of the embodiments, the tracks are relatively large and clumsy. This does not obviously have to be the case and the tracks may be designed to be adapted to sturdy shoes and dress shoes, that is, larger tracks for sturdier shoes and thinner and finer tracks for dress shoes.

The arrangement according to the present invention makes it possible to improve the way the shoe fits on very thin dress shoes on which, for aesthetical reasons, it has been desirable to avoid conventional shoe laces. This applies to men's shoes as well as to women's shoes. The tracks may on thin dress shoes be designed so that they do not disturb the overall look and the locking part (fastener) may be designed, as required, to a desired shape that does not disturb but is an aesthetically appealing detail.

In the embodiments described above, the tracks and the locking parts have been symmetrically arranged in the middle of the shoe and the tracks have been extending along the length of the shoe. It is obviously not at all necessary and the arrangement according to the present invention may be adjusted to an asymmetrically disposed cavity on the shoe that defines the separate parts of the upper part of the shoe that may be tightened when the shoe is put on. The locking part and the tracks may also be located at a cavity on the side of the shoe and the cavity must obviously be in communication with the opening 2. The embodiment of the present invention may principally be arranged over a cavity that extends in any direction from the opening 2.

In the illustrated embodiments, the transverse parts of the locking part are made of a relatively stiff material, such as plastic or metal.

Another suitable embodiment is to make the transverse parts from one or several transverse laces that connect the movable members disposed in the tracks. The advantage of using laces is that they can easily be made longer and shorter and it is easy to grip the laces to move the locking part.

In the above described embodiments, the locking part includes only one transverse part wherein the separated parts are only completely fixed right across this part. The locking part may obviously include several transverse parts of which each one is connected with the movable members in the tracks, respectively. When designing with several transverse parts, the parts that are situated right across on each side of the cavity and fixed relative to another that is many places along the cavity are fixed sideways relative to the corresponding places on the other side of the cavity.

In the illustrated embodiments, the locking is performed lengthwise, that is the locking is backwardly and unintentional opening of the cavity is prevented by hooks and the members that are movable within the tracks are cooperating with openings or protruding material portions. The lengthwise locking along the cavity may also be done with the locking part or fastener by designing the locking part or fastener so that it cooperates with hooks that are disposed along the cavity.

Because the tracks, that are made of plastic or metal, stiffen the shoe material it may be preferable to add weak spots are regular distances. For example, material sections may be removed to provide weaknesses to reduce the bendability of the tracks right across each weakness.

This may also be achieved by providing the tracks with track parts that are separately disposed along the length of the shoe so that the entire tracks may be bendable and conforming.

The arrangement of the present invention may not include tracks on each side of the cavity. The scope of the appended patent claims also include one track that extends along one side of the cavity and that an arm that spans the cavity may be attached to a point on the opposite side of the cavity.

What is claimed is:

1. An arrangement for a shoe wear for removable attachment of the shoe wear about a user's foot, comprising:

a first part of the shoe wear;

a second part of the shoe wear;

an opening defined in the shoe wear;

a cavity defined between the first and second parts to separate the first part from the second part and extending from the opening;

a transverse locking part extending across the cavity, the transverse locking part having one end movably attached to the first part and an opposite end attached to the second part, the transverse locking part being movable along the cavity to a tightened position and a locked position by moving the transverse locking part so that the first and second parts are pulled towards one another;

the arrangement further comprising a first track arranged on the first part and a second part arranged on the second track on each side of the cavity, the tracks extending in a lengthwise direction along the cavity, the tracks being arranged to diverge in a direction towards the opening of the shoe wear, the transverse locking part extending across the cavity between the first and second tracks and is in engagement with the tracks via a member that is movable along the first and second tracks, the cavity being in an openable by moving the transverse locking part away from the opening and being closeable by moving the transverse locking part in a direction to pull the first track and the second track towards one another, the transverse locking part being lockable in a plurality of setting positions along the first and second tracks;

the first and second tracks each having an upwardly open groove, each groove having a plurality of stop members disposed along its length on wall segments that face the cavity, the stop members cooperate with a part of a cylindrical member that is movable within the tracks to lock the locking part in a plurality of setting positions along the tracks; and the wall segments having openings defined therein and the locking part having a protruding hook on the movable cylindrical member.

2. The arrangement according to claim 1 wherein the cavity extends mainly in the lengthwise direction of the shoe wear from the opening and towards the front end of the shoe wear.

3. The arrangement according to claim 1 wherein the cavity extends at an angle from the opening of the shoe wear and towards a shoe sole.

4. The arrangement according to claim 1 wherein the first and second tracks are bendable.

5. The arrangement according to claim 1 wherein the protruding hook is insertable into the openings defined in the wall segments.

6. The arrangement according to claim 1 wherein the locking part is rotatably attached to the tracks.

7. The arrangement according to claim 1 wherein, the locking part is shiftable along a rail attached to the shoe wear.

8. The arrangement according to claim 1 wherein, the locking part is attached to a stop member disposed inside each track.

9. The arrangement according to claim 1 wherein the locking part is adjustable to be shortened or lengthened by an extension of the locking part between the first and second tracks so that the locking part is adjustable to different foot widths of the user.

10. The arrangement according to claim 1 wherein a cylindrical member, that is movable along the first and second tracks, has a friction reducing member that is adapted to roll against an elongate impact absorbing part in each track.

11. The arrangement according to claim 1 wherein the first and second tracks and the locking part are a separate unit that is removably attached to a conventional shoe wear.

* * * * *